US006355138B1

(12) United States Patent
Doelle

(10) Patent No.: US 6,355,138 B1
(45) Date of Patent: Mar. 12, 2002

(54) METHOD OF CHEMICALLY LOADING FIBERS IN A FIBER SUSPENSION

(75) Inventor: Klaus Doelle, Menasha, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/512,191

(22) Filed: Feb. 24, 2000

(51) Int. Cl.[7] ..... D21H 17/70

(52) U.S. Cl. ..... 162/9; 162/100; 162/181.2; 162/182; 162/183

(58) Field of Search ..... 162/9, 100, 181.2, 162/182, 183

(56) References Cited

U.S. PATENT DOCUMENTS

| | | | | |
|---|---|---|---|---|
| 4,927,618 A | | 5/1990 | Mathur et al. | 423/432 |
| 4,980,395 A | | 12/1990 | Mathur et al. | 523/200 |
| 5,120,521 A | | 6/1992 | Ebinuma et al. | 423/432 |
| 5,223,090 A | | 6/1993 | Klungness et al. | 162/9 |
| 5,332,564 A | | 7/1994 | Chapnerkar et al. | 423/432 |
| 5,364,610 A | | 11/1994 | Merris, Jr. | 423/432 |
| 5,643,415 A | | 7/1997 | Wise | 162/181.2 |
| 5,679,220 A | * | 10/1997 | Matthew et al. | 162/9 |

FOREIGN PATENT DOCUMENTS

| | | | |
|---|---|---|---|
| EP | 0 179 597 | 4/1986 | C01F/11/18 |
| EP | 0 791 685 A2 | 8/1997 | D21H/17/70 |
| EP | 0 799 797 BA | 10/1997 | C01F/11/18 |

* cited by examiner

*Primary Examiner*—Peter Chin
(74) *Attorney, Agent, or Firm*—Taylor & Aust, P.C.

(57) ABSTRACT

A method of continuously loading fibers in a fiber suspension with calcium carbonate. The fibers include a fiber wall surrounding a lumen. A reactant solid in the form of calcium oxide and/or calcium hydroxide is mixed into the fiber suspension with a resultant initial process pH of between 11 and 12. The fiber suspension is transported at a consistency of between approximately 15 and 30% into an inner chamber of a closed reactor. A reactant gas is injected into the reactor, whereby the reactor is pressurized to a pressure between 5 and 150 psi. A temperature of the fiber suspension within the reactor is controlled at a range between −10° C. and 80° C. The fibers within the fiber suspension are loaded with calcium carbonate as a result of a chemical reaction between the reactant solid and the reactant gas in the reactor over a predetermined reaction time. A specific type of calcium carbonate crystals are grown on the fiber walls of the fibers, depending upon the initial process pH, temperature, pressure and reaction time.

21 Claims, 2 Drawing Sheets

METHOD OF CHEMICALLY LOADING FIBERS IN A FIBER SUSPENSION

BACKGROUND OF THE INVENTION

1. Field of the Invention

The present invention relates to a method of loading fibers in a fiber suspension for use in a paper-making machine with a chemical compound, and, more particularly, to a method for loading fibers in a fiber suspension with calcium carbonate.

2. Description of the Related Art

A paper-making machine receives a fiber suspension including a plurality of fibers, such as wood fibers, which are suspended within an aqueous solution. The water is drained from the fiber suspension and dried in the paper-making machine to increase the fiber content and thereby produce a fiber web as an end product.

The fiber web produced by the paper-making machine typically includes organic wood fibers and inorganic fillers. A known inorganic filler is calcium carbonate, which may be added directly to the fiber suspension (direct loaded calcium carbonate). It is also known to chemically load the fibers within a fiber suspension with calcium carbonate in the lumen and walls of the individual fibers (fiber loaded calcium carbonate). The fiber loaded calcium carbonate increases the strength of the paper compared with a direct loaded calcium carbonate (adding calcium carbonate directly to the fiber suspension) at the same loading (filler) level. This yields an economic advantage in that the filler level of the paper is increased by replacing the more expensive fiber source (wood fibers) with calcium carbonate. The finished paper web has higher strength properties due to the increased filler levels of the calcium carbonate. In contrast, the strength properties of a finished web using direct loaded calcium carbonate is less.

For example, U.S. Pat. No. 5,223,090 (Klungness, et al.) discloses a method for chemically loading a fiber suspension with calcium carbonate. In one described method, calcium oxide or calcium hydroxide is placed within a refiner unit and carbon dioxide is injected into the refiner unit at a specified pressure. The fiber suspension is maintained within the refiner for a predetermined period of time to ensure that a proper chemical reaction and thus proper chemical loading of the fiber suspension occurs. In another described method, a fiber suspension with calcium oxide or calcium hydroxide is introduced into a 20 quart food mixer and carbon dioxide gas is injected into the mixer at a specified pressure. Using either the refiner or the food mixer, both methods utilize a batch processing method for processing only a small amount of the fiber suspension at a time. Because of the large amount of fiber suspension which is required at the wet end of a paper-making machine, a batch process requires that the chemically loaded fiber suspension be transferred to another holding tank for ultimate use in a paper-making machine.

What is needed in the art is a method for chemically loading calcium carbonate in and on fibers in a fiber suspension for use in a paper-making machine, which allows commercialization of such a chemical loading process, and which allows the physical properties of the fiber web to be altered.

SUMMARY OF THE INVENTION

The present invention provides a fiber loading apparatus which effectively loads fibers within a fiber suspension, and which is compactly constructed and arranged to occupy less physical space.

The invention comprises, in one form thereof, a method of continuously loading fibers in a fiber suspension with calcium carbonate. The fibers include a fiber wall surrounding a lumen. A reactant solid in the form of calcium oxide and/or calcium hydroxide is mixed into the fiber suspension with a resultant initial process pH of between 11 and 12. The fiber suspension is transported at a consistency of between approximately 15 and 30% into an inner chamber of a closed reactor. A reactant gas is injected into the reactor, whereby the reactor is pressurized to a pressure between 5 and 150 psi. A temperature of the fiber suspension within the reactor is controlled at a range between −10° C. and 80° C. The fibers within the fiber suspension are loaded with calcium carbonate as a result of a chemical reaction between the reactant solid and the reactant gas in the reactor over a predetermined reaction time. A specific type of calcium carbonate crystals are grown on the fiber walls of the fibers, depending upon the initial process pH, temperature, pressure and reaction time.

An advantage of the present invention is that the fiber loading of the fiber in the fiber suspension takes place as a continuous process, thereby providing output quantities of loaded fiber suspension sufficient for use in a paper-making machine.

Another advantage is that variables such as flow rate, temperature and pressure which affect the fiber loading process can be accommodated and varied.

Yet another advantage is that specific types of calcium carbonate crystals are grown on the fiber walls of the individual fibers, thereby providing different physical properties to the fiber web produced as an end product.

BRIEF DESCRIPTION OF THE DRAWING

The above-mentioned and other features and advantages of this invention, and the manner of attaining them, will become more apparent and the invention will be better understood by reference to the following description of an embodiment of the invention taken in conjunction with the accompanying drawings, wherein.

The exemplification set out herein illustrates one preferred embodiment of the invention, in one form, and such exemplification is not to be construed as limiting the scope of the invention in any manner.

DETAILED DESCRIPTION OF THE INVENTION

Figure 1:
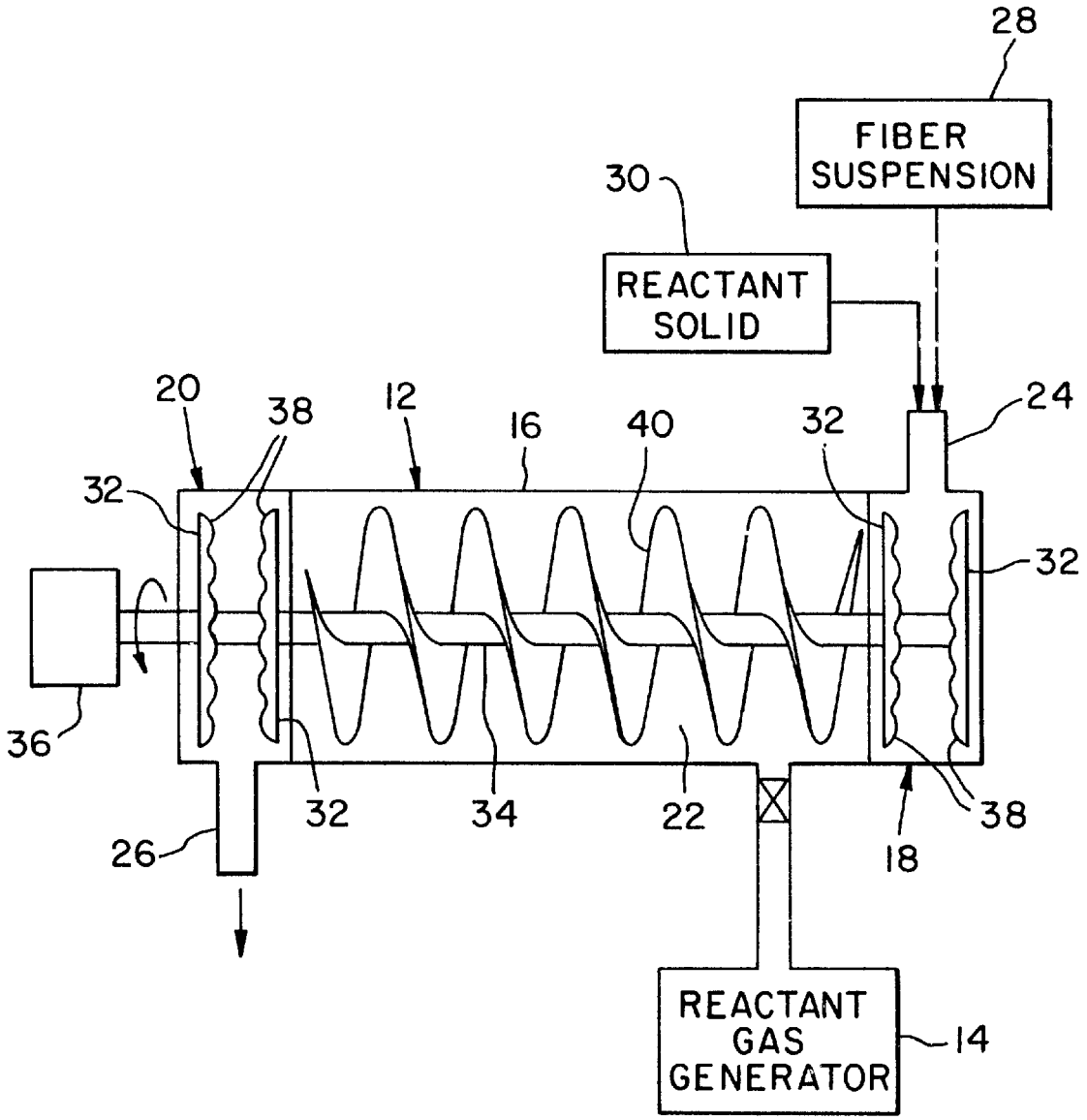
FIG. 1 is a schematic illustration of a fiber loading apparatus which may be used to carry out an embodiment of the method of the present invention for loading fibers in a fiber suspension with a calcium carbonate.

Referring now to the drawings, and more particularly to FIG. 1, there is shown an embodiment of a fiber loading apparatus 10 used to carry out an embodiment of the method of the present invention for loading fibers in a fiber suspension with calcium carbonate. Fiber loading apparatus 10 generally includes a reactor 12 and a reactant gas generator 14.

Reactant gas generator 14 generates a reactant gas which is injected into reactor 12 and used in the chemical reaction to form the calcium carbonate which is loaded into and on the fibers within reactor 12. Reactant gas generator 14 generates carbon dioxide and/or ozone which is injected into reactor 12. In the embodiment shown, reactant gas generator 14 is in the form of an apparatus carrying out a combustion process which generates carbon dioxide used within reactor 12. For example, reactant gas generator 14 may be in the form of an internal combustion engine used as a generator, mechanical drive, etc. during processing of the fiber suspension which produces carbon dioxide as a by-product of the combustion process carried out therein. The carbon dioxide is used as a reactant gas within reactor 12.

Reactor 12 generally includes a housing 16, first fluffer 18, second fluffer 20 and inner chamber 22. Housing 16 includes an inlet 24 and an outlet 26. Inlet 24 is disposed in direct fluid communication with first fluffer 18; and outlet 26 is disposed in direct fluid communication with second fluffer 20. Inlet 24 receives a fiber suspension 28 to be loaded with calcium carbonate, and concurrently receives a reactant solid 30 used as a reactant in the chemical reaction to produce the calcium carbonate. Fiber suspension 28 may include virgin and/or recycled fibers, with the individual fibers having a fiber wall surrounding a lumen.

Reactant solid 30, in the embodiment shown, is in the form of calcium oxide and/or calcium hydroxide used in the chemical reaction within reactor 12. Reactant solid 30 is mixed with fiber suspension 28 to provide an initial process pH of between 11 and 12. In the embodiment shown, reactant solid 30 is in the form of lime which is mixed with fiber suspension 28 prior to introduction within first fluffer 18. However, reactant solid 30 may also be mixed with the fiber suspension within first fluffer 18 and/or inner chamber 22.

First fluffer 18 and second fluffer 20 each include a pair of refiner plates 32 which are carried by and rotationally driven by a common drive shaft 34 coupled with a drive source 36.

Each refiner plate 32 has an axially facing contoured refiner surface 38 which faces toward and coacts with a complementary refiner plate 32. First fluffer 18 and second fluffer 20 are configured to allow continuous throughput of fiber suspension 28 and reactant solid 30 through reactor 12, while at the same time defining a closed (i.e., substantially sealed) reaction chamber within inner chamber 22.

Drive shaft 34 also carries a mixing element in the form of an auger 40 which is disposed within inner chamber 22. Auger 40 transports fiber suspension 28 and reactant solid 30 from first fluffer 18 to second fluffer 20. The throughput rate through inner chamber 22, and thus the reaction time of the chemical reaction which occurs within inner chamber 22, is primarily dependent upon the pitch and rotational speed of auger 40.

In the embodiment shown, reactant solid is in the form of calcium hydroxide and reactant gas generator 14 provides a reactant gas in the form of carbon dioxide, as indicated above. Thus, the chemical reaction occurring within inner chamber 22 is represented by the chemical equation:

$$Ca(OH)_2+CO_2 \leftrightharpoons CaCO_3+H_2O$$

The calcium carbonate thus produced by the chemical reaction is effectively loaded into the lumen and grown as crystals on the fiber walls of a substantial portion of the fibers within the fiber suspension by controlling the initial process pH, temperature, pressure, reaction time, lime slaking temperature and lime average particle size within inner chamber 22. Dependent upon the specific application for which the fiber suspension is to be utilized (e.g., paper, carton, cardboard, tissue, etc.) the different types of crystals which may be grown on and in the fiber walls as well as on the fiber surface and between fibers of the individual fibers provide different physical properties to the resultant end product in the form of a fiber web. By precisely monitoring and controlling the initial process pH, reaction temperature, reaction pressure, reaction time, lime slaking temperature and lime average particle size as indicated above, a specific type of calcium carbonate crystal is controllably grown on the fiber walls, thereby altering the physical properties of the resultant fiber web.

For example, using the fiber loading method of the present invention in a fiber loading apparatus such as shown in FIG. 1, rhombohedral, scalenohedral, aciculares aragonite and substantially spherical-shaped crystals can be formed on and in the fiber walls as well as on the fiber surface and between the individual fibers. Applicant's have found that rhombohedral calcium carbonate crystals may be grown on and in the fiber walls as well as on the fiber surface and between fibers of the individual fibers if the initial process pH is controlled between approximately 5 and 12.4, preferably between 7 and 10, and more preferably between 8 and 9, the reaction temperature is controlled between approximately −12° and 100° C., preferably −10° and 40° C., and more preferably between 15° and 30° C.; the reaction pressure is controlled between approximately 0 and 10 bar, preferably 1 and 8 bar, and more preferably between 1 and 4 bar; the reaction time is controlled between approximately 0.5 and 30 minutes, preferably between 1 and 15 minutes, and more preferably between 1 and 6 minutes; lime slaking temperature is controlled between 10° and 100° C., preferably between 10° and 70° C., and more preferably between 10° and 50° C., and lime average particle size is between 0.5 and 5 micro-meter. More particularly, it has been found that rhombohedral calcium carbonate crystals may be optimally grown on the fiber walls on the individual fibers if the pH is approximately 8, the reaction temperature is approximately 15° C., the reaction pressure is approximately 1 bar, the reaction time is approximately 1 minute, the temperature at mixing with the fibers, lime and carbon dioxide is above 15° C., preferably approximately 20° C., and lime average particle size is approximately 0.5 to 5 micro-meter.

Additionally, scalenohedral crystals may be grown on the fiber walls of the individual fibers if the initial process pH is between approximately 5 and 12.4, preferably between 7 and 10, and more preferably between 8 and 9; the reaction temperature is between approximately −12° and 100° C., preferably between 40° and 90° C., and more preferably between 50° and 75° C.; the reaction pressure is between approximately 0 and 10 bar, preferably between 1 and 8 bar and more preferably between 1 and 4 bar; the reaction time is between approximately 0.5 and 30 minutes, preferably between 1 and 15 minutes, and more preferably between 1 and 6 minutes; the lime slaking temperature is between 10° and 100° C., preferably between 10° and 70° C., and more preferably between 10° and 50° C.; and lime temperature at mixing with fibers is above 35° C., and lime average particle size is approximately 0.5 to 5 micro-meter. Scalenohedral calcium carbonate crystals may be optimally grown on and in the fiber walls of the individual fibers as well as the fiber surface and in between fibers if the initial process pH is approximately 8, the reaction temperature is approximately 50° C., the reaction pressure is approximately 1 bar, the reaction time is approximately 1 minute, the mixing temperature of lime, fibers and carbon dioxide is above 35° C., and lime average particle size is approximately 0.5 to 5 micro-meter.

Figure 2:
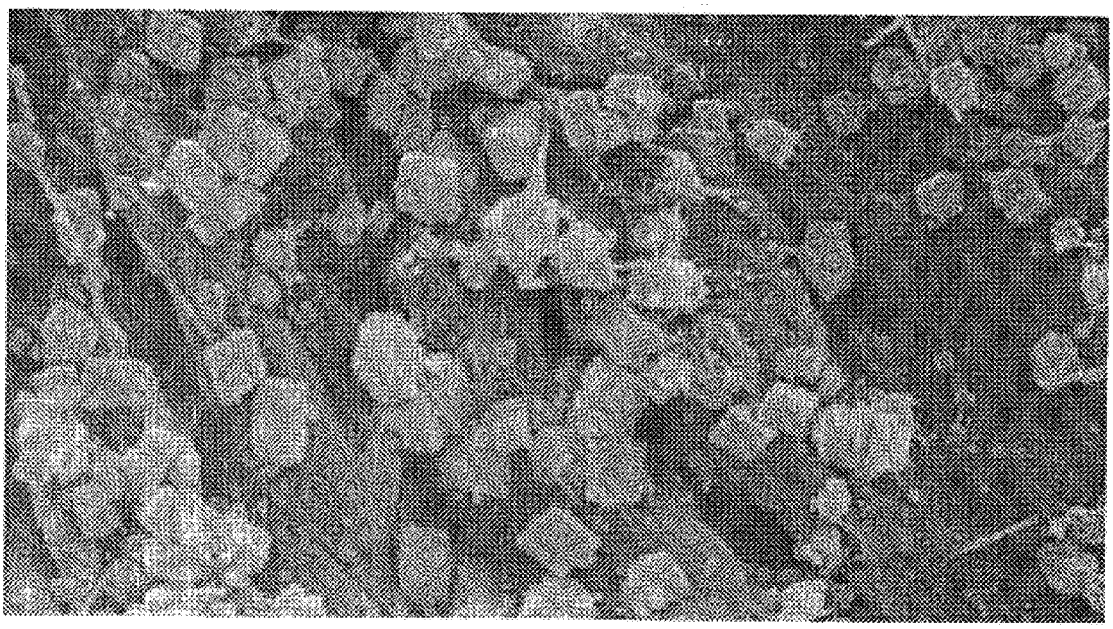
FIG. 2 is an enlarged view of scalenohedral calcium carbonate crystals which may be grown on fiber walls of individual fibers within a fiber suspension using the fiber loading method of the present invention.
Figure 3:
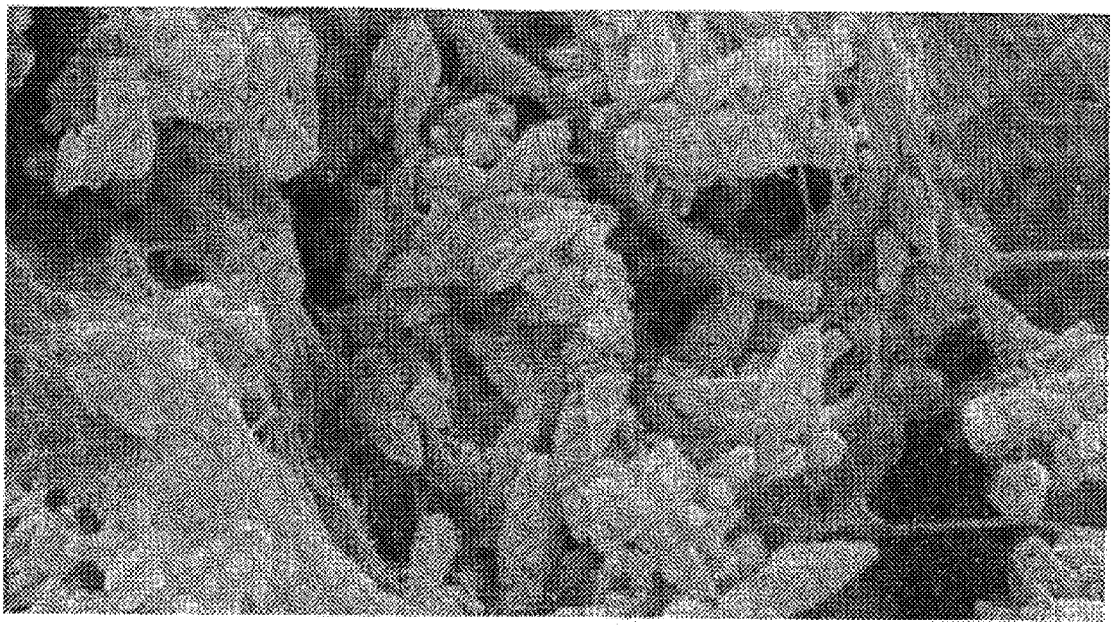
FIG. 3 is an enlarged view of rhombohedral calcium carbonate crystals which may be grown on the fiber walls of individual fibers within a fiber suspension using the fiber loading method of the present invention.

FIG. 2 illustrates scalenohedral calcium carbonate crystals 42 which may be selectively grown on fibers 44 using the fiber loading method of the present invention as described above. Moreover, FIG. 3 illustrate rhombohedral calcium carbonate crystals 46 which may be selectively grown on fibers 44 using the fiber loading method of the present invention as described above.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of continuously loading fibers in a fiber suspension with calcium carbonate, the fibers including a fiber wall surrounding a lumen, said method comprising the steps of:

mixing a reactant solid comprising at least one of calcium oxide and calcium hydroxide into the fiber suspension with a resultant initial process pH of between 11 and 12;

transporting the fiber suspension at a consistency of between approximately 15 and 30% into an inner chamber of a closed reactor, said reactor including a first fluffer and a second fluffer, said inner chamber disposed between and interconnecting said first fluffer and said second fluffer, said reactor further including a mixing element mounted within said inner chamber;

injecting a reactant gas into said reactor, whereby said reactor is pressurized to a reaction pressure of between 5 and 150 pounds per square inch;

controlling a reaction temperature of the fiber suspension within said reactor between −10° C. and 80° C.; and loading fibers within the fiber suspension with calcium carbonate as a result of a chemical reaction between said reactant solid and said reactant gas in said reactor over a predetermined reaction time, said loading step including the sub-step of growing a specific type of calcium carbonate crystals on the fiber walls of said fibers dependent upon said initial process pH, said reaction temperature, said pressure and said reaction time.

2. The method of claim 1, wherein said specific type of calcium carbonate crystals consists of one of rhombohedral, scalenohedral, aciculares aragonite and substantially spherical-shaped crystals.

3. The method of claim 2, wherein said specific type of calcium carbonate crystals consists of rhombohedral crystals.

4. A method of continuously loading fibers in a fiber suspension with calcium carbonate, the fibers including a fiber wall surrounding a lumen, said method comprising the steps of:

mixing a reactant solid comprising at least one of calcium oxide and calcium hydroxide into the fiber suspension with a resultant initial process pH of between approximately 8 and 9, said mixing step defining a lime slaking step, said lime slaking occurring at a temperature of between approximately 10° C. and 50° C., said reactant solid having an average particle size of between about 0.5 $\mu$m and 5 $\mu$m;

transporting the fiber suspension at a consistency of between approximately 15 and 30% into an inner chamber of a closed reactor;

injecting a reactant gas into said reactor, whereby said reactor is pressurized to a reaction pressure of between approximately 1 and 4 bar;

controlling a reaction temperature of the fiber suspension within said reactor between 15° C. and 30° C.; and loading fibers within the fiber suspension with calcium carbonate as a result of a chemical reaction between said reactant solid and said reactant gas in said reactor over a predetermined reaction time, said reaction time being between approximately 1 and 6 minutes, said loading step including the sub-step of growing a specific type of calcium carbonate crystals on the fiber walls of said fibers dependent upon said initial process pH, said reaction temperature, said pressure and said reaction time, said specific type of calcium carbonate crystals being grown consisting of rhombohedral crystals.

5. The method of claim 4, wherein said initial process pH is approximately 8, said reaction temperature is approximately 15° C., said reaction pressure is approximately 1 bar, said reaction time is approximately 1 minute, said lime temperature at mixing is above 35° C., and said lime average particle size is between 0.5 and 5 micro-meter.

6. The method of claim 2, wherein said specific type of calcium carbonate crystals consists of scalenohedral crystals.

7. A method of continuously loading fibers in a fiber suspension with calcium carbonate, the fibers including a fiber wall surrounding a lumen, said method comprising the steps of:

mixing a reactant solid comprising at least one of calcium oxide and calcium hydroxide into the fiber suspension with a resultant initial process pH of between approximately 8 and 9, said mixing step defining a lime slaking step, said lime slaking occurring at a temperature of between approximately 10° C. and 50° C., said reactant solid having an average particle size of between about 0.5 $\mu$m and 5 $\mu$m;

transporting the fiber suspension at a consistency of between approximately 15 and 30% into an inner chamber of a closed reactor;

injecting a reactant gas into said reactor, whereby said reactor is pressurized to a reaction pressure of between approximately 1 and 4 bar;

controlling a reaction temperature of the fiber suspension within said reactor between 50° C. and 75° C.; and loading fibers within the fiber suspension with calcium carbonate as a result of a chemical reaction between said reactant solid and said reactant gas in said reactor over a predetermined reaction time, said reaction time being between approximately 1 and 6 minutes, said loading step including the sub-step of growing a specific type of calcium carbonate crystals on the fiber walls of said fibers dependent upon said initial process pH, said reaction temperature, said pressure and said reaction time, said specific type of calcium carbonate crystals being grown consisting of scalenohedral crystals.

8. The method of claim 7, wherein said initial process pH is approximately 8, said reaction temperature is approximately 50° C., said reaction pressure is approximately 1 bar, said reaction time is approximately 1 minute, said lime mixing temperature is above 35° C., and said lime average particle size is between 0.5 and 5 micro-meter.

9. The method of claim 1, wherein said mixing element comprises an auger.

10. The method of claim 9, wherein each of said first fluffer and said second fluffer are configured to substantially seal said reactor.

11. The method of claim 1, wherein said injecting step comprises injecting a reactant gas consisting essentially of carbon dioxide and ozone.

12. The method of claim 1, wherein said reactant gas comprises carbon dioxide, and comprising the further step of generating said carbon dioxide using a combustion process associated with processing of the fiber suspension.

13. A method of continuously loading fibers in a fiber suspension with calcium carbonate, the fibers including a fiber wall surrounding a lumen, said method comprising the steps of:

mixing a reactant solid comprising at least one of calcium oxide and calcium hydroxide into the fiber suspension with a resultant initial process pH of between 11 and 12;

transporting the fiber suspension at a consistency of between approximately 15 and 30% into an inner chamber of a closed reactor, said reactor including a first fluffer, a second fluffer, an inner chamber disposed between and interconnecting said first fluffer and said second fluffer, and a mixing element within said inner chamber;

generating carbon dioxide using a combustion process associated with processing of the fiber suspension;

injecting said carbon dioxide into said reactor, whereby said inner chamber is pressurized to a pressure of between 5 and 150 pounds per square inch;

controlling a temperature of the fiber suspension within said reactor between −10° C. and 80° C.; and loading fibers within the fiber suspension with calcium carbonate as a result of a chemical reaction between said reactant solid and said carbon dioxide in said reactor over a predetermined reaction time, said loading step including the sub-step of growing a specific type of calcium carbonate crystals on the fiber walls of said fibers dependent upon said initial process pH, said temperature, said pressure and said reaction time.

14. The method of claim 13, wherein said specific type of calcium carbonate crystals consists of one of rhombohedral, scalenohedral, aciculares aragonite and substantially spherical-shaped crystals.

15. The method of claim 14, wherein said specific type of calcium carbonate crystals consists of rhombohedral crystals.

16. The method of claim 15, wherein said initial process pH is between approximately 8, and 9, said temperature is between approximately 15° and 30° C., said pressure is between approximately 1 and 4 bar, said reaction time is between approximately 1 and 6 minutes, said lime temperature at mixing is between approximately 10° and 50° C., and said lime average particle size is between 0.5 and 5 micrometer.

17. The method of claim 16, wherein said initial process pH is approximately 8, said temperature is approximately 15° C., said pressure is approximately 1 bar, said reaction time is approximately 1 minute, said lime slaking temperature is above 35° C., and said lime average particle size is between 0.5 and 5 micro-meter.

18. The method of claim 14, wherein said specific type of calcium carbonate crystals consists of scalenohedral crystals.

19. The method of claim 18, wherein said initial process pH is between approximately 8 and 9, said temperature is between approximately 50° and 75° C., said pressure is between approximately 1 and 4 bar, said reaction time is between approximately 1 and 6 minutes, said lime slaking temperature is between approximately 10° and 50° C., and said lime average particle size is between 0.5 and 5 micrometer.

20. The method of claim 19, wherein said initial process pH is approximately 8, said reaction temperature is approximately 50° C., said pressure is approximately 1 bar, said reaction time is approximately 1 minute, said lime temperature at mixing is above 35° C., and said lime average particle size is between 0.5 and 5 micro-meter.

21. The method of claim 1, wherein said injecting step comprises injecting a reactant gas consisting essentially of carbon dioxide.

* * * * *